United States Patent [19]

Törnqvist

[11] 4,240,219

[45] Dec. 23, 1980

[54] SYSTEM FOR DISPLAYING A NUMBER OF PICTURES, NOTICES OR SIMILAR ANNOUNCEMENTS

[76] Inventor: Peter J. T. Törnqvist, Barkassvägen 11, Lidingö, Sweden

[21] Appl. No.: 929,935

[22] Filed: Aug. 1, 1978

[30] Foreign Application Priority Data

Aug. 9, 1977 [SE] Sweden ..... 7709028

[51] Int. Cl.[3] ..... G09F 11/30

[52] U.S. Cl. ..... 40/476; 40/511

[58] Field of Search ..... 40/476, 508, 511

[56] References Cited

U.S. PATENT DOCUMENTS

| | | | |
|---|---|---|---|
| 1,224,261 | 5/1917 | Billerman | 40/476 |
| 2,729,007 | 1/1956 | Littman | 40/476 |
| 2,770,899 | 11/1956 | Littman | 40/476 |
| 3,568,345 | 3/1971 | Grosse | 40/476 |

FOREIGN PATENT DOCUMENTS

| | | | |
|---|---|---|---|
| 2411331 | 9/1974 | United Kingdom | 40/476 |

*Primary Examiner*—John F. Pitrelli

*Attorney, Agent, or Firm*—Frishauf, Holtz, Goodman & Woodward

[57] ABSTRACT

A system for displaying a number of pictures, notices, or similar announcements comprises a number of flexible sheets each provided with pictures, notices, etc. and cooperating with respective suspension devices for suspending the sheets in a divided stacker. The suspension devices, for example in the form of pins, project beyond the sheet on either side thereof and the stacker collects the projecting suspension devices so as to store the sheets, preferably hanging vertically. Each sheet is provided with a substantially stiff outer grip member which is gripped and moved by a feed system. The feed system moves the sheet and the suspension member for the respective sheets so as to displace the suspension member to sequentially display successive sheets or the like.

14 Claims, 4 Drawing Figures

SYSTEM FOR DISPLAYING A NUMBER OF PICTURES, NOTICES OR SIMILAR ANNOUNCEMENTS

BACKGROUND OF THE INVENTION

This invention relates to a system for displaying a number of pictures, notices or similar announcements, and more particularly to such a system comprising a number of flexible sheets provided with pictures, notices, etc., and co-operating with means which are adapted for suspension of said sheets in a divided stacker and which means each projects, in the form of pins, beyond the sheet on either side thereof, the stacker being adapted to collect the said suspension means and, in so doing, store the sheets, preferably hanging vertically, and a feed system adapted to move the sheets.

Display machines and similar devices for displaying pictures are already known, for example, from Swedish Pat. No. 73 03560-2, Swedish Laid-Open Specification No. 358 985, U.S. Pat. No. 2,135,207, German Patent No. 246 230 and U.K. Patent No. 7686 of 1913. The disadvantage of all these prior art systems and those available today is that they are complex constructions which use complicated chain drives or friction drives to transport the sheets. In many of the known systems, the displayed pictures move slightly even during the display time, and this is a very disturbing effect.

Other disadvantages of the prior art systems are that they are difficult to repair quickly, since usually the entire display machine has to be taken to the service engineer. It is also a complex job to change the sheet material in the known systems. The noise level is often very disturbing in the known systems as a result of the drive method and mechanical complexity, and frequently it is not possible to change the display time. Furthermore, most of the known display machines are heavy and bulky.

SUMMARY OF THE INVENTION

The object of this invention is to provide the above problems and disadvantages as far as possible. In accordance with the present invention, each end of each sheet is provided with a preferably substantially stiff outer grip member, which is adapted to be gripped and moved by a feed system. Each sheet is provided, near its respective end, with a stop means to stop the relative displacement of the sheet in relation to the associated suspension means, such displacement being produced by the said feed system, each grip member is located farther away from the center of the associated sheet than is the associated stop means, and the suspension means for each sheet are each adapted to be relatively displaceable from one stop means of the respective sheet to its second stop means on change of the picture, etc. The invention provides a mechanically uncomplicated lightweight and small silent-running system which is easy to replace and which has any number of pictures as required, each of which is stationary for the entire display time and easily fitted into the system.

DETAILED DESCRIPTION

Figure 1:
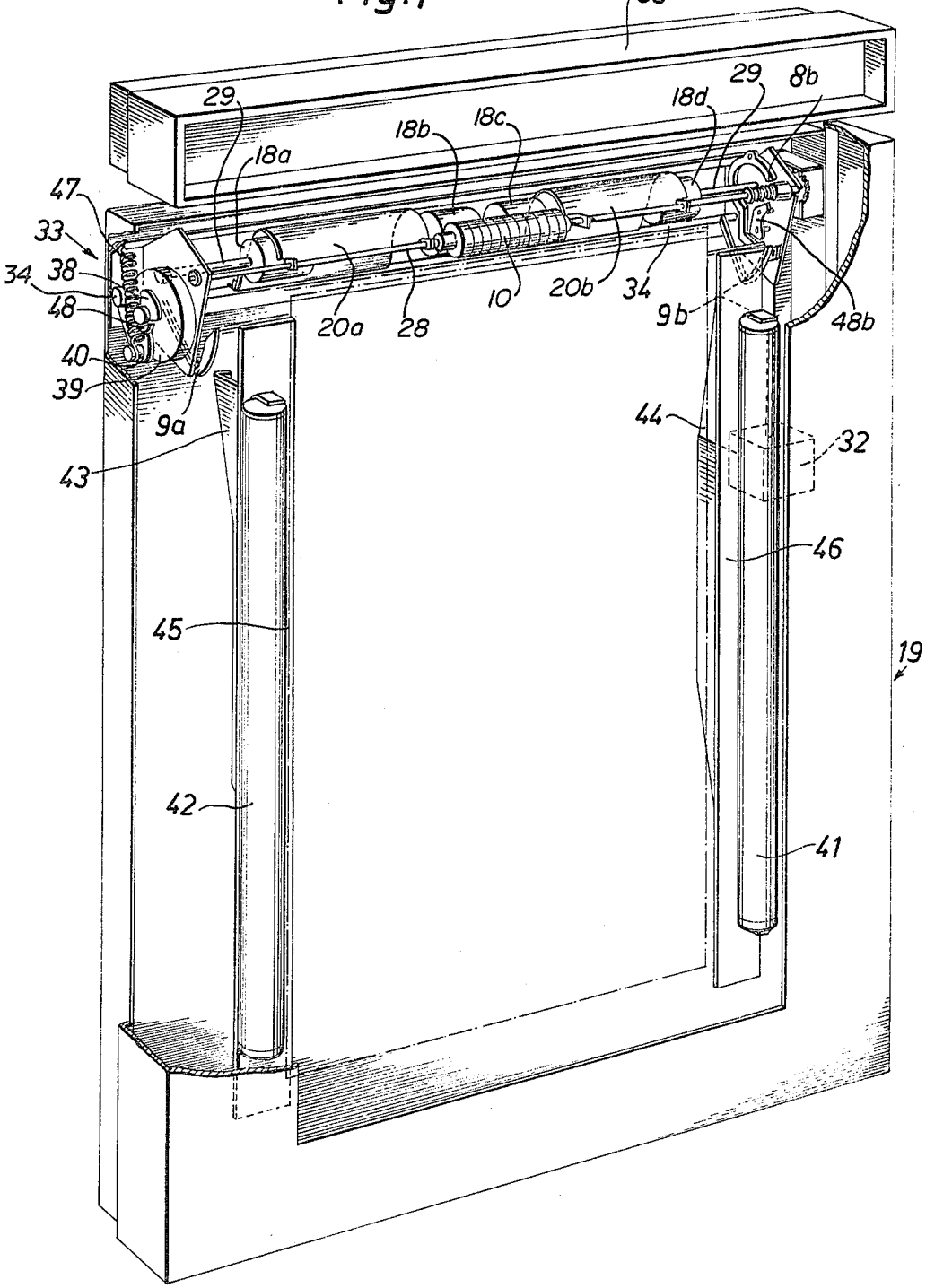
FIG. 1 is a perspective view of a display machine for posters, some of the parts having been removed.

Referring to FIG. 1, reference numeral 19 denotes a display machine for publicity posters, announcements, notices etc. A device 35 to draw attention may be disposed above the machine 19 and, for example, bear a suitable text which illuminates or flashes on each change of display.

Figure 2:
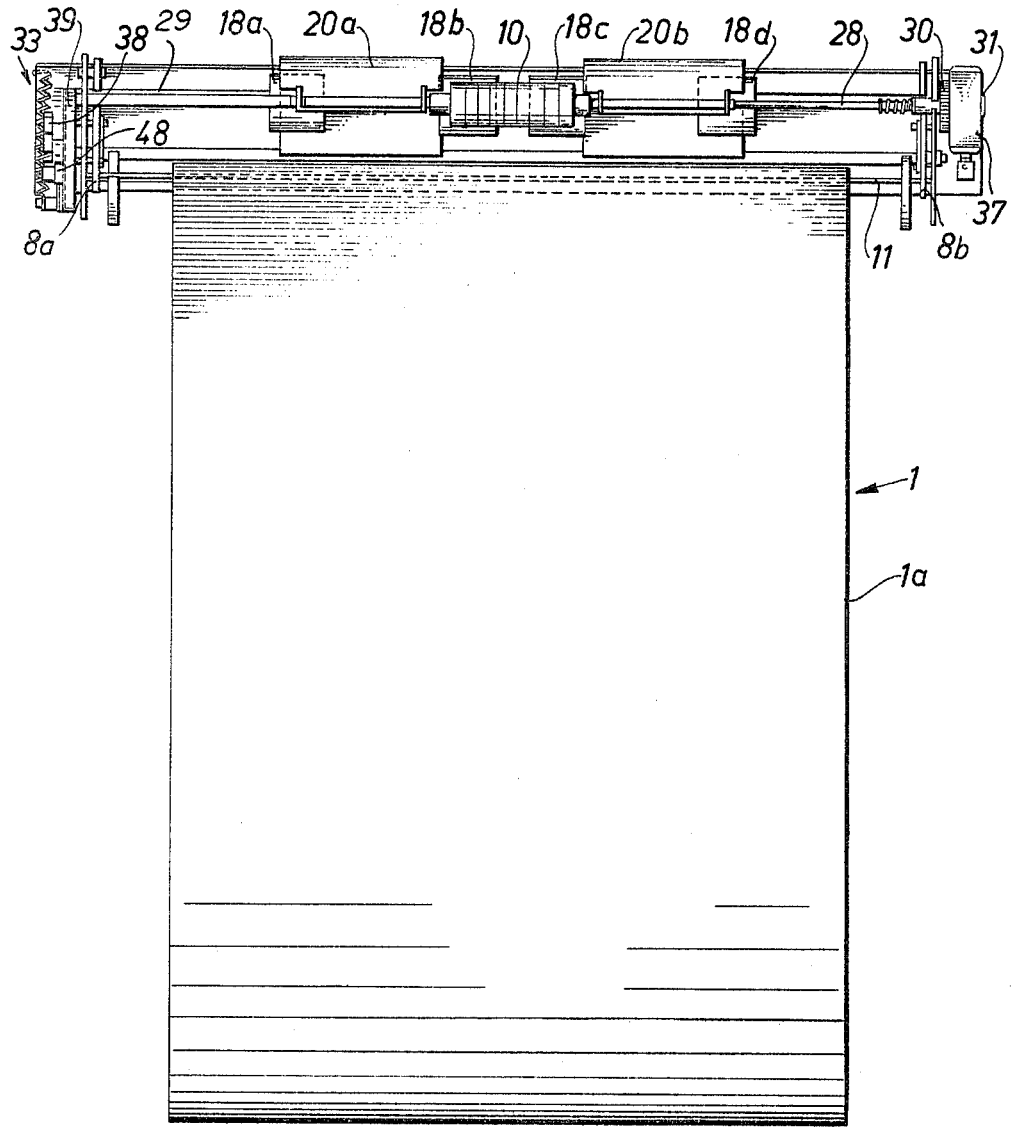
FIG. 2 is a front view of the actual display changing mechanism.
Figure 3:
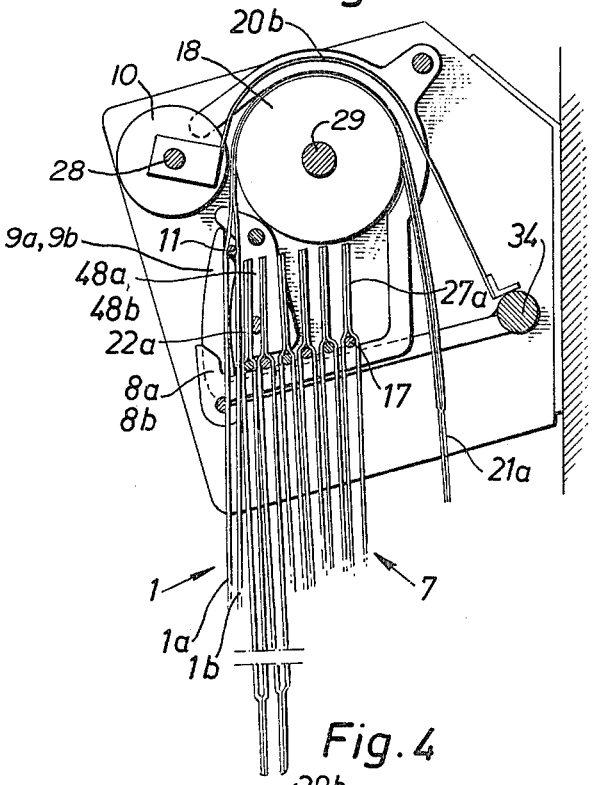
FIGS. 3 and 4 are end views of the mechanism with a sheet in different positions.
Figure 4:
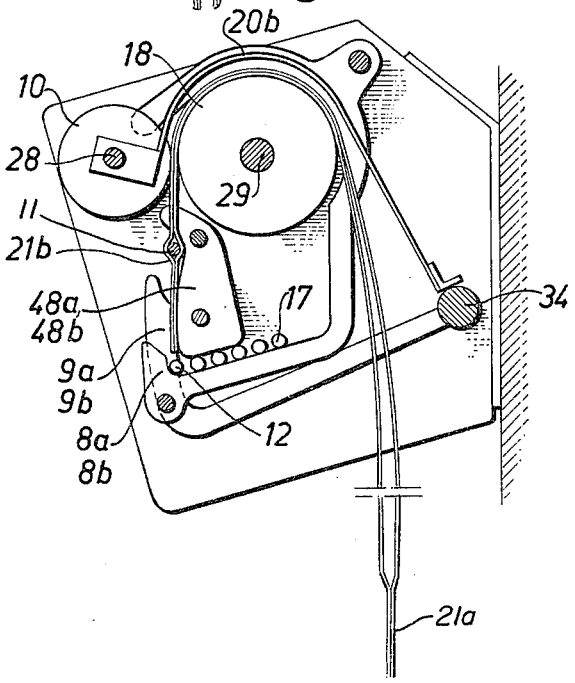

As best seen in FIGS. 3 and 4, a convenient number of suspension means 11–17, preferably constructed in the form of rods, are disposed on a stacker at the top of the display machine 19. As seen in FIG. 2, the stacker is divided into two parts 8*a*, 8*b*, which are located near the ends of the rods 11–17 and which are each constructed (a) with a part which substantially follows the periphery of the rollers 18*a*–18*d* and (b) with a part which is directed downwardly at an angle and on which the end positions of the rods 11–17 rest. Seven suspension rods 11–17 are shown in the embodiment, but this number may vary.

A closed loop 1–7 advantageously runs over each rod 11–17 and each loop consists of a front 1*a* and a back 1*b*, etc., these sides being provided with the text to be displayed. Each closed loop 1–7 is provided with two transistion zones 21*a* (FIG. 3), 21*b* (FIG. 4) between the back 1*b* and the front 1*a*. These zones project upwardly and downwardly as will be apparent, inter alia, from FIGS. 3 and 4, and are constructed to be rather stiff but still flexible.

An electric motor 32 (FIG. 1) which advantageously rotates at constant speed is disposed at a suitable location in the display machine 19 and is connected via a shaft to a gear 37 (see FIG. 2) which in turn drives the shaft 29 and, via two gearwheels 30—one of which is constructed as a one-way coupling to allow synchronization of the rollers—another shaft 28, the shaft 28 being provided with a feed roller 10 of suitable material, e.g. soft rubber, and the shaft 29 being provided with a feed roller 18*a*, 18*b*, 18*c*, 18*d* divided up into a plurality of parts, the rollers 10, 18 having been given opposite directions of rotation. That end of shaft 29 which is furthest away from the gear 37 also drives a circular member 33, which is adapted to rotate a shaft 34 at suitable adjustable intervals, displacement means 9*a*, 9*b* being fixed on said shaft 34. The internally toothed wheel 39 disposed inside the circular member 33 and driven by the shaft 29 acts, via a cam 48, on a spring-loaded profiled lever 40, the profile of which is so selected in relation to the peripheral speed of the rollers that the displacement means move at the same speed as the rollers, and which is in turn connected to the shaft 34. A component 38, which may have various sizes, can be connected to the wheel 39 so that the display time can be varied within certain limits.

Guide means in the form of curved plates 20*a*, 20*b* are disposed above the rollers 10, 18.

Each poster, etc., may alternatively be driven by means of perforations in the posters and a sprocket wheel (not shown) on the shaft 29. Alternatively, of course, other methods of moving the sheets or loops may be used, e.g. by means of chains, displaceable suction cups, magnets, and the like.

The display machine 19 may also be provided with suitable illumination in the form, for example, of fluorescent tubes 41, 42 FIG. 1, the direct light of which is shielded from any one looking at the sides of the display machine. For the sake of clarity, however, this system is not shown completely in the drawings. The machine 19 is also provided with guide plates 43, 44 FIG. 1, which are widened obliquely outwards at the top part to guide the edges of the posters 1–7, and abutment plates 45, 46 against which the front poster 1 is to bear.

The system according to the invention operates as follows: The motor 32 drives the shafts 28 and 29, so that the rollers 10, 18 rotate in opposite directions. Shaft 29 also drives wheel 39 and, after a certain display time, e.g. 5 seconds, the cam 48 actuates the lever 40 so that the shaft 34 is turned in a counter-clockwise direction—with respect to FIG. 4—for as long as the top hook-shaped parts of the displacement means 9*a*, 9*b* connected to the shaft 34 are at a level below the ends of the rod 11 held at the front in the stacker 8*a*, 8*b*. This rod 11 is pressed by gravity against a stop at the front end of the stacker 8*a*, 8*b* and when a spring 47 then forces the lever 40 to reverse, the shaft 34 is rotated in the clockwise direction according to FIG. 3 into the position shown in that Figure. During this movement, the rod 11 is driven by the top ends of the displacement means 9*a*, 9*b* and in doing so slides against an abutment 48*a*, 48*b* and during this displacement the end surfaces of the rod 11 are guided by shaped surfaces. In these conditions the rod 11 assumes the position shown in FIG. 3. Since the poster 1 constructed as a closed loop around the rod 11 naturally also follows the rod 11, the projecting transition zone 21*a* comes in between the rollers 10, 18 and the poster 1 is thus driven upwardly and is guided by the guide plates 20*a*, 20*b* to move down behind the other posters 2–7 and when the second transition zone 21*b* of the poster 1 has almost reached the rod 11 the displacement means 9*a*, 9*b* are moved down somewhat by rotation of the shaft 34 so that the second transition zone can drive the rod 11 around the roller 18 clamped against the stacker 8 to a position further to the right in the stacker 8 as considered with respect to FIG. 3.

The front 2*a* of the poster 2 is now exposed in the machine and the change of display takes place in the same way as described hereinbefore. In this connection it should be noted that that side of each poster which was the front will become the back after a number of changes corresponding to the number of closed loops in the machine, and thus a poster will alternately display its front and back. It should also be noted that both parts 8*a* and 8*b* of the stacker guides the ends of the rods 11–17 for the entire period except when the rods 11–17 are actuated by the displacement means 9.

The term "sheet" in this context denotes plane or double articles, objects, etc., e.g. in the form of paper, textiles or plastics provided with suitable texts and/or pictures.

Instead of using one motor for driving all the shafts, it is of course possible to use a plurality of motors each driving its own shaft. Also, if desired, the said single motor may be replaced by a manual drive.

Instead of a closed loop, each sheet may, if required, be constructed as a single sheet with a stop means at each end. Furthermore, instead of whole rods, suspension means divided into two parts may be used, and if desired they may be slotted, the slots cooperating with the stop means at the ends of the posters. In such cases, the poster stop means may advantageously be constructed as thickened portions or similar end stops.

I claim:

1. System for displaying and changing the display of a number of pictures, notices, or the like, comprising:

a plurality of flexible sheets (1–7), each provided with pictures, notices, or the like;

suspension means (11–17) coupled to said sheets for suspension of said sheets;

a divided stacker (8*a*,8*b*) for receiving said suspension means, said stacker including means projecting beyond the sheet on either side thereof, said stacker including means for engaging said suspension means and, in doing so, storing the sheets (1–7), preferably hanging vertically;

feed means (10–18) located adjacent said stacker and adapted to displace or move the sheets (1–7) relative to the associated suspension means;

each end of each sheet being provided with a substantially stiff outer grip (21*a*–27*a*; 21*b*–27*b*), which is adapted to be gripped and moved by said feed means (10–18 );

each sheet (1–7) being provided, near its respective ends, with a respective stop means (21*a*, 21*b*, etc.) to stop the relative displacement of the sheet in relation to the associated suspension means, such displacement being produced by the said feed means (10–18);

each grip member (21*a*–27*a*) being located farther away from the center of the associated sheet than is the associated stop means; and said suspension means (11–17) each being relatively displaceable from one stop means (21*a*, etc.) at one end of the respective sheet (1–7) to its second stop means (21*b*, etc.) at the other end of the respective sheet on a display change of the flexible sheet.

2. The system of claim 1, wherein each sheet (1–7) is constructed as a closed loop having a front (1*a*–7*a*) and a back (1*b*–7*b*); and said stop means of each sheet comprising a transition zone (21–27) between the front and back of the sheet, respectively; said suspension means (11–17) being disposed within the associated closed loop and being adapted to be relatively displaceable from one transition zone (21*a*–27*a*) of the loop to a second transition zone (21*b*–27*b*) thereof on change of the display.

3. The system of claim 2, wherein each transition zone (21–27) also forms one of said grip members, each of which projects from the front and back (1*a*, 1*b*, etc.) and from the suspension means (11–17) of a respective sheet.

4. The system of claim 2 or 1, wherein the outside of the closed loop is provided with the said fronts and backs.

5. The system of claim 2 or 1, comprising displacement means (9*a*,9*b*) for displacing said suspension means (11–17) from a position in which either the front or back of the associated closed loop is displayed, to an additional position in which the grip member (21*a*, etc.) of the sheet is gripped and fed by the said feed means (10, 18), said suspension means (11–17) being retained by said displacement means (9*a*,9*b*) in said additional position, and said suspension means (11–17) being disengaged from said displacement means and driven by the second transition zone of said loop through said feed means.

6. The system of claim 5, wherein said stacker includes guide means for guiding said suspension means (11–17) except when they are guided by said displacement means (9) or by said closed loop.

7. The system of any one of claims 1, 2 or 3, wherein said stacker and feed means comprise the top part of a vertically hanging display machine (19) or the like.

8. The system of claim 7, wherein said stacker and feed means comprise a unit which is releasable from the display machine (19) or the like.

9. The system of any one of claims 1, 2 or 3, wherein said feed means comprises at least two rollers (10, 18) extending towards one another and rotatably driven with opposite directions of rotation, and a guide means (20) adjacent at least one of said rollers for changing the direction of the sheet feed.

10. The system of claim 9, wherein each roller has its own shaft (28,29), and comprising a motor (32) operating at a substantially constant speed coupled to said shafts and rotatably driving said rollers (10, 18).

11. The system of claim 10, at least one shaft (28) is coupled to said motor via an one-way coupling.

12. The system of claim 10, wherein at least one shaft (28) is adapted to be readily releasable.

13. The system of claim 10, comprising means (33) coupling said motor (32) to drive said displacement means (9), said coupling means (33) being adjustable to vary the time during which the respective sheets are displayed.

14. The system of claim 13, wherein said coupling means (33) is driven by said motor (32) via one of said shafts (29), said coupling means (33) comprising two lifting means (**9*a*,9*b*) which are disposed on a common shaft (34) and which are so disposed as to co-operate with those parts of said suspension means (11–17) which project beyond the respective loops, said lifting means (9*a*,9*b*) being constructed so as to be displaced, on rotation of said common shaft (34), into a position beneath said stacker (8*a*,8*b*) and to then lift a closed loop (1, etc.), stored in said stacker, into said additional position, in which the said grip members (21*a*–27*a* etc.) of the loop are gripped and fed on by said feed means (10, 18**).

* * * * *

UNITED STATES PATENT AND TRADEMARK OFFICE

CERTIFICATE OF CORRECTION

PATENT NO. : 4,240,219

DATED : December 23, 1980

INVENTOR(S) : Peter J. T. TORNQVIST

It is certified that error appears in the above—identified patent and that said Letters Patent is hereby corrected as shown below:

COLUMN 4 (claim 4), line 49, change "claim 2 or 1" to

--claim 2 or 3--;

COLUMN 4 (claim 5), line 52, change "claim 2 or 1" to

--claim 2 or 3--.

Signed and Sealed this

*Ninth* Day of *June 1981*

[SEAL]

*Attest:*

RENE D. TEGTMEYER

*Attesting Officer* *Acting Commissioner of Patents and Trademarks*